US007455049B2

(12) United States Patent
Feinleib

(10) Patent No.: US 7,455,049 B2
(45) Date of Patent: Nov. 25, 2008

(54) ACTUATING MECHANISM FOR HYDRAULICALLY DRIVEN PUMP-INJECTOR FOR INTERNAL COMBUSTION ENGINES

(75) Inventor: Boris Feinleib, Jerusalem (IL)

(73) Assignee: Mazrek Ltd., Jerusalem (IL)

( * ) Notice: Subject to any disclaimer, the term of this patent is extended or adjusted under 35 U.S.C. 154(b) by 0 days.

(21) Appl. No.: 11/587,275

(22) PCT Filed: Feb. 11, 2004

(86) PCT No.: PCT/IL2004/000133

§ 371 (c)(1),
(2), (4) Date: Feb. 7, 2007

(87) PCT Pub. No.: WO2005/078271

PCT Pub. Date: Aug. 25, 2005

(65) Prior Publication Data

US 2007/0221178 A1 Sep. 27, 2007

(51) Int. Cl.
*F02M 47/02* (2006.01)

(52) U.S. Cl. ..... 123/447

(58) Field of Classification Search ..... 123/447, 123/497, 499, 476

See application file for complete search history.

(56) References Cited

U.S. PATENT DOCUMENTS

| | | | | |
|---|---|---|---|---|
| 4,176,822 | A | 12/1979 | Chadwick | |
| 4,437,443 | A * | 3/1984 | Hofbauer | 123/446 |
| 4,590,903 | A * | 5/1986 | Hofmann et al. | 123/300 |
| RE33,270 | E * | 7/1990 | Beck et al. | 123/447 |
| 5,213,083 | A * | 5/1993 | Glassey | 123/447 |
| 5,884,848 | A | 3/1999 | Crofts et al. | |
| 7,017,553 | B2 * | 3/2006 | Boehland | 123/446 |
| 7,059,303 | B2 * | 6/2006 | Magel et al. | 123/447 |
| 2002/0000219 | A1 * | 1/2002 | Augustin et al. | 123/502 |

FOREIGN PATENT DOCUMENTS

| | | |
|---|---|---|
| EP | 0 770 174 B1 | 11/2001 |
| JP | 61-8459 | 1/1986 |
| WO | 01/53690 A2 | 7/2001 |

* cited by examiner

*Primary Examiner*—Erick Solis
(74) *Attorney, Agent, or Firm*—Nath Law Group; Jerald L. Meyer; Stan N. Protigal

(57) ABSTRACT

Actuating mechanism for hydraulically driven pump-injectors for internal combustion engines specifically for diesels, which in order to reduce dimensions of pump-injector body, comprises pressure intensifier with several power pistons and a pumping plunger.

16 Claims, 4 Drawing Sheets

ACTUATING MECHANISM FOR HYDRAULICALLY DRIVEN PUMP-INJECTOR FOR INTERNAL COMBUSTION ENGINES

TECHNICAL FIELD

Present invention relates to the field of fuel supply systems for internal combustion engines, in particular to diesels and their fuel pump-injectors having hydraulic actuating mechanism for driving the pumping plunger.

BACKGROUND ART

Conventional hydraulically driven pump-injectors with actuating mechanism comprise: a body with inlet and outlet channels for the connection with accumulator (rail) of actuating fluid (which is in turn connected to the actuating fluid pump), and a drain tank or sump, respectively; pressure intensifier, comprising a power piston and a pumping plunger, a working cavity being formed above the said power piston in the body, into which the actuating fluid is introduced via said inlet channel in the body, and a drain cavity under the power piston connected to the drain tank or sump by an additional channel being formed in the said body; distributing device with a valve, predominantly having an electromagnetic drive controlled by an electronic control unit mounted in the body between said inlet and outlet channels, and the working cavity above the power piston; a return mechanism of the power piston with pumping plunger, and a sprayer unit.

When high factors of pressure multiplication (10 and more) are used, which are needed for obtaining high injection pressure (2000 bars and above) with moderate pressure of the actuating liquid (up to 200 bars), the power piston in conventional pump-injectors with single-piston pressure intensifier must necessarily have a large diameter. As a result, the pump-injector body also has a large diameter. This makes it difficult to modify and upgrade existing diesel engines to incorporate advanced fuel injection systems based on hydraulically driven pump-injectors, due to space limitations in the engines cylinder head, where relatively small diameter injectors or pump-injectors are used.

DISCLOSURE OF INVENTION

The present invention is aimed at significantly decreasing the diameters of hydraulically driven pump-injectors by replacing a conventional single-piston actuating mechanism used in conventional hydraulically driven pump-injectors with a multi-piston actuating mechanism comprising a tandem of power pistons. This allows for decreasing the diameter of power pistons, and, consequently, of pump-injectors.

In accordance with this invention, hydraulically driven pump-injector with actuating mechanism comprises: a body with inlet and outlet channels for the connection with an accumulator (rail) of actuating fluid (which is in turn connected to the actuating fluid pump), and a drain tank or sump, respectively; a multi-piston pressure intensifier comprising several power pistons and one pumping plunger; a distributing device with a valve, predominantly having an electromagnetic drive controlled by an electronic control unit (the valve can also be controlled by piezoelectric, magnetostriction, mechanical or other devices), mounted in the body between said inlet and outlet channels and the working cavities of the power pistons; a return mechanism (for instance, a spring mechanism) of power pistons with pumping plunger, said pressure intensifier comprising two or more power pistons that drive the pumping plunger, the pistons being disposed in cylindrical bores of the body, working cavities being formed above the pistons, which are connected with the accumulator (rail) of the actuating fluid by said distributing device of actuating fluid and said inlet channel in the body, and drain cavities being formed under the pistons, connected with the drain tank or sump by said outlet channels formed in the body. In order to decrease the diameter of the body, the power pistons are arranged coaxially with each other and with the pumping plunger, one after another, in tandem, rods being installed between the power pistons and transferring the force from one piston to another. The rods are moving inside the partitions formed directly in the body or in a bushing, which is tightly installed in the body. Said partitions separate the drain cavity of the previous piston (which is disposed closer to the distributing device) from the working cavity of the next piston, and the working cavity of the first power piston disposed next to the distributing device, i.e. the leader, is bounded by the surface of the internal cylindrical cavity of the pump-injector body. The actuating fluid is supplied to the pistons' working cavities from the distributing device through channels made in the body, or from the working cavity of the previous piston to the working cavity of the next piston, i.e. the follower. In this case, the first piston (the leader) in the piston tandem is connected with the distributing device by an additional channel. Another design option is also possible, in which the actuating fluid from the working cavity of the previous piston enters the working cavity of the next piston through an opening in the bottom of the previous piston and a central channel disposed along the rod, which transfers the force from the previous piston to the next piston. In this case, the pistons of a multi-piston pressure intensifier can have identical or different diameters. Using pistons of different diameters allows for equalizing the forces transferred by each piston to the pumping plunger.

This invention envisages phase (time) shift in supplying the actuating fluid into above-piston working cavities of the pistons that follow the leader in order to achieve rate shape and thus allow for increasing the engine life and lowering the noise and exhaust emission levels.

Design features allowing for achieving rate shape are described in detail in the section "Summary of the Invention".

The proposed multi-piston actuating mechanism can be used in hydraulically driven pump-injectors using fuel (the same that will eventually be injected into the combustion chamber) or oil as actuating fluid.

SUMMARY OF THE INVENTION

A functional diagram of a hydraulically driven pump-injector with actuating mechanism having two pistons in which the actuating fluid from above-piston working cavity of the first piston (leader) is supplied to the above-piston working cavity of the second piston (follower) via a channel in the body is shown in FIG. 1, as an example of the embodiment of a multi-piston actuating mechanism.

Figure 1:
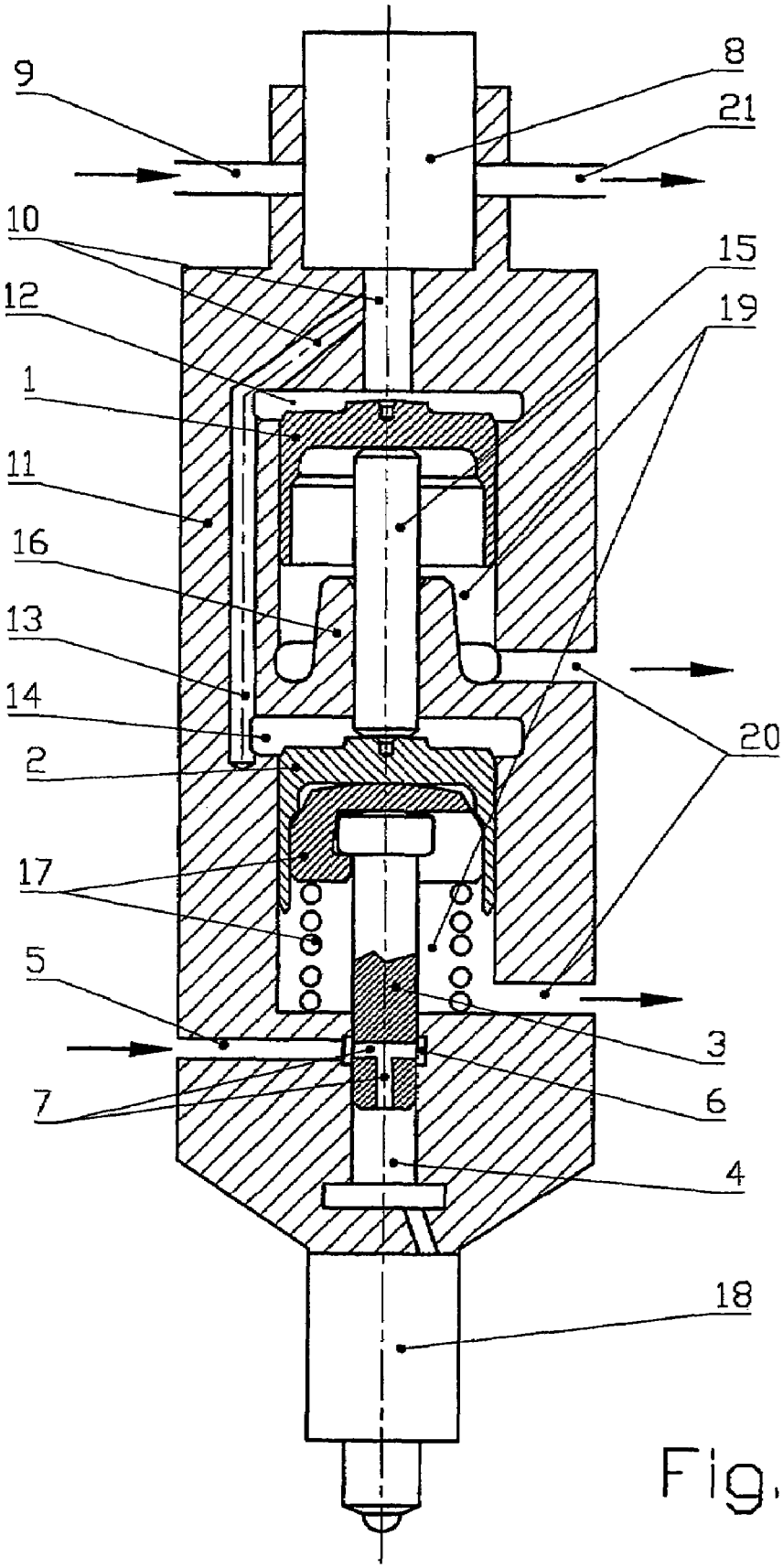

In FIG. 1:

1—the first power piston (leader) of the pressure intensifier

2—the second power piston (follower) of the pressure intensifier

3—pumping plunger

4—under-plunger cavity

5—channel, through which the fuel is supplied into the body for subsequent supply into under-plunger cavity 4 through filling channels 7

6—groove in the body, connecting channel 5 with filling channels 7 of pumping plunger 3

7—filling channels in the plunger

8—distributing device of the actuating fluid

9—inlet channel, connecting distributing device 8 with accumulator (rail) of actuating fluid

10—channel connecting distributing device 8 with above-piston working cavity 12 of piston1 (leader)

11—body

12—above-piston cavity of piston 1 (leader)

13—channels in the body, connecting above-piston working cavity 12 of piston 1 (leader) with above-piston working cavity 14 of piston 2 (follower)

14—above-piston working cavity of piston 2 (follower)

15—rod that transfers the force from piston 1 (leader) to piston 2 (follower)

16—partition in the body, in which rod 15 moves

17—spring with seat of the return mechanism that moves power pistons 1 and 2 jointly with the pumping plunger 3 into extreme upper position after the end of the working stroke

18—sprayer unit

19—under-piston cavities of pistons 1 and 2

20—channels connecting drain under-piston cavities 19 of pistons 1 and 2 with a drain tank or sump.

Figure 2:
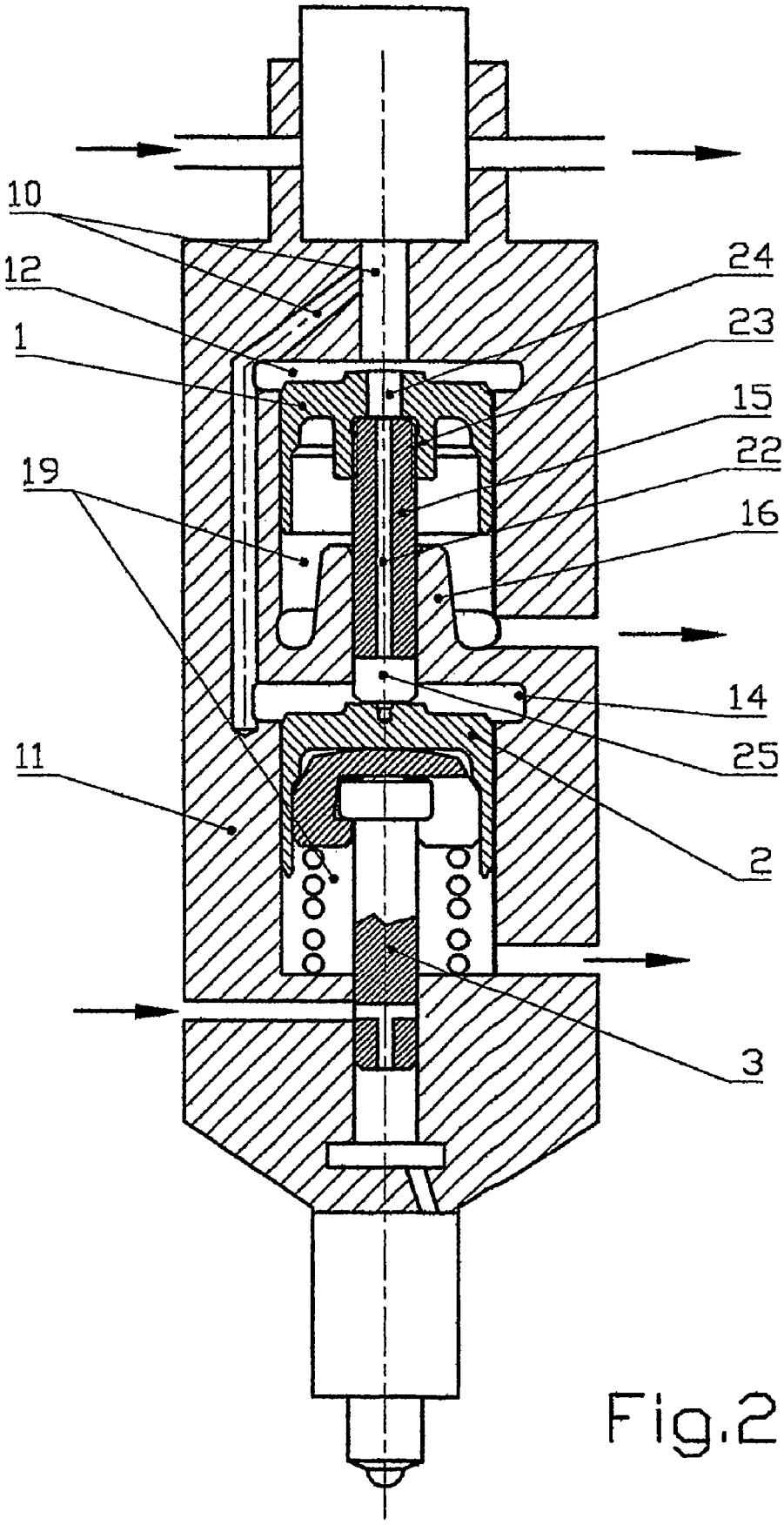
FIG. 2 shows a functional diagram of a pump-injector with two-piston actuating mechanism, in which the actuating fluid from above-piston working cavity of the first piston (leader) is supplied to the above-piston working cavity of the second piston (follower) via a channel in the rod that transfers the force from the leading piston to the next piston.

21—outlet channel connecting the body with a drain tank or sump when the actuating fluid is expelled by the power pistons during their return stroke In FIG. 2:

22—central channel in rod 15, through which actuating fluid is supplied from above-piston working cavity 12 of piston 1 (leader) into above-piston working cavity 14 of piston 2 (follower)

23—threaded joint of rod 15 with piston 1 (leader)

24—opening in the piston bottom, through which the actuating fluid is supplied from above-piston working cavity 12 into channel 22

25—slots, through which the actuating fluid is supplied from channel 22 of rod 15 into above-piston working cavity 14 of piston 2 (follower)

Figure 3:
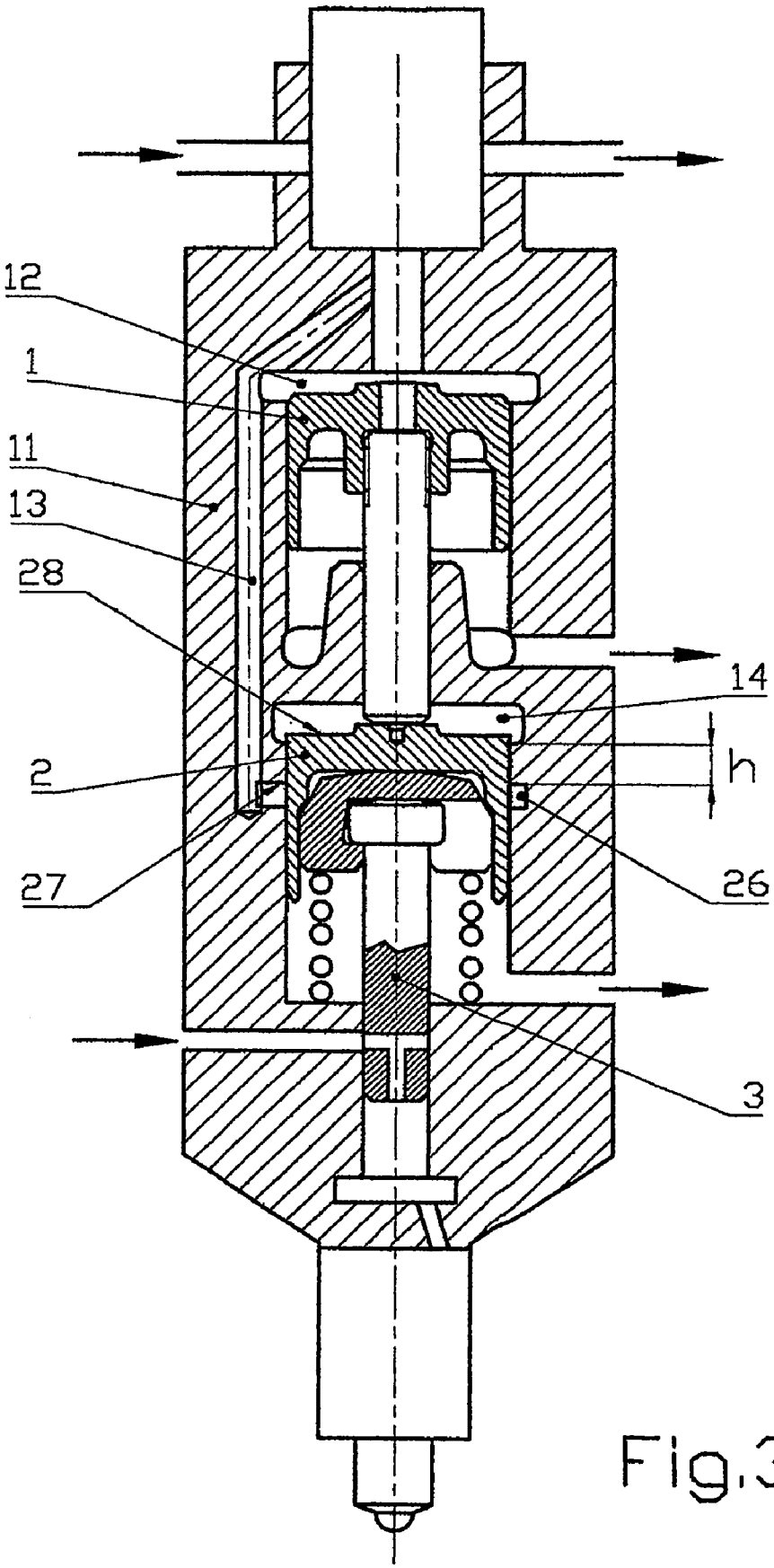
FIG. 3 shows a functional diagram of a device for achieving rate shape in a pump-injector shown in FIG. 1.

In FIG. 3:

26—annular groove in body 11, through which the actuating fluid is supplied from channel 13 into above-piston working cavity 14 of piston 2 (follower)

27—upper edge of groove 26

28—face of piston 2 (follower)

Figure 4:
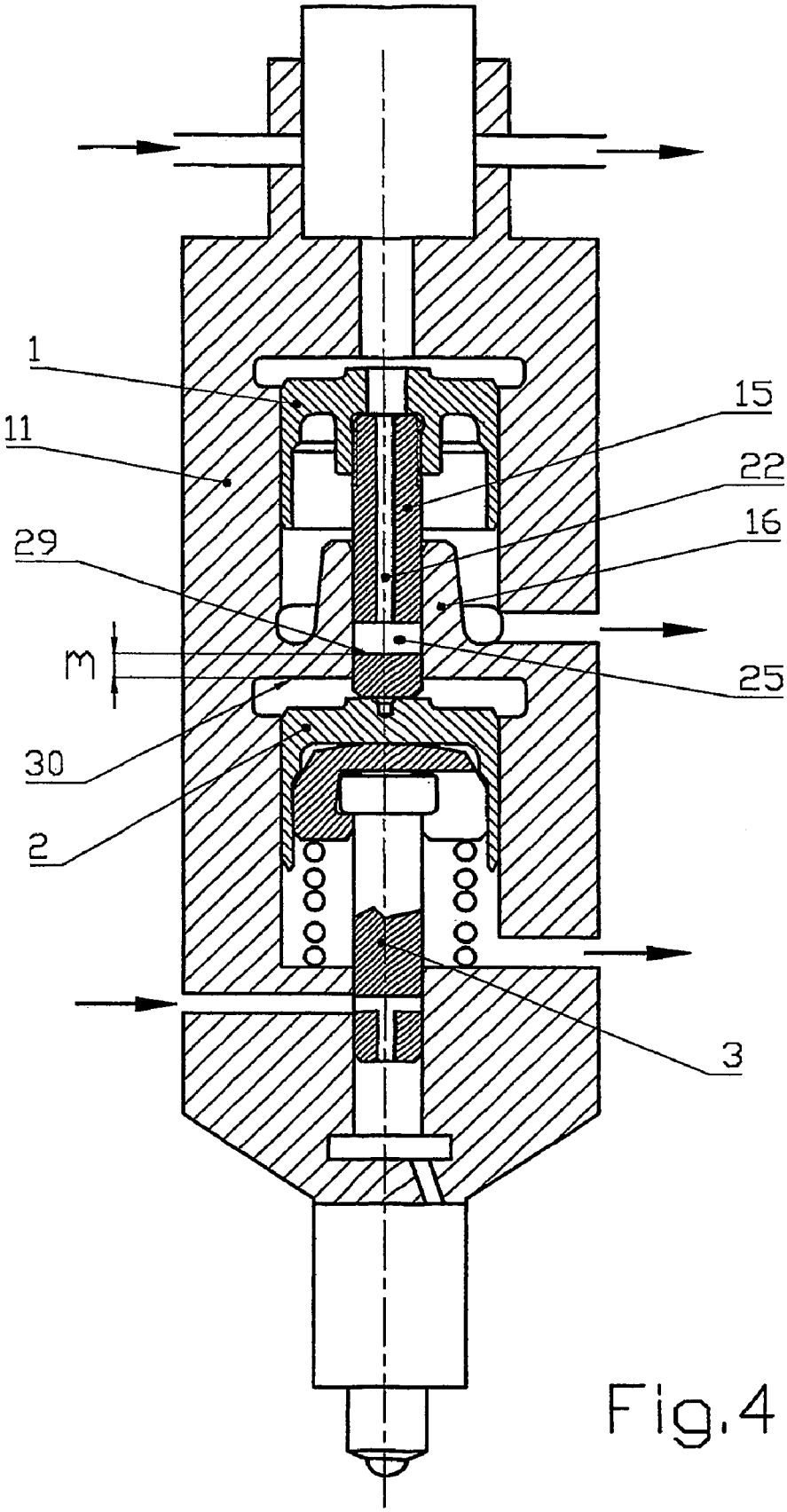
FIG. 4 shows a functional diagram of a device for achieving rate shape in a pump-injector shown in FIG. 2.

In FIG. 4:

29—lower edge of openings of slots 25 of rod 15

30—lower surface of partition 16 in body 11

Pump-injector with the proposed multi-piston actuating mechanism shown in FIG. 1 operates as follows:

When power pistons 1 and 2 with pumping plunger 3 are in extreme upper position, the under-plunger cavity 4 is filled with fuel (actuating fluid) via channel 5 in body 11, groove 6 and channels 7 in plunger 3.

When the electromagnet of the valve of distributing device 8 is energized (here the operation of pump-injector is described using an example of a distributing device with electromagnetically controlled valve, but, as mentioned above, the proposed device can use other types of controlling devices described above), the actuating fluid through inlet channel 9, distributing device 8 and channels 10 in body 11 is supplied into above-piston working cavity 12 of piston 1 and from it via channel 13 in body 11 into above-piston working cavity 14 of piston 2. Under the pressure of the actuating fluid, pistons 1 and 2 together with rod 15, installed in partition 16 of body 11, and plunger 3, press the return spring of device 17 and move into extreme lower position, and plunger 3 after channels 7 are disconnected from groove 6 forces the fuel via sprayer unit 18 into the engine's combustion chamber. During the working stroke of the pistons, when they move downward as shown in FIG. 1, the emulsion formed as a result of the mixing of the air and actuating fluid leaking through the gaps between the pistons and the body, is evacuated from space 19 under the pistons via channels 20 into the drain tank or sump. When the electromagnet of the valve of distributing device 8 is de-energized, the actuating fluid ceases to flow from distributing device 8 to above-piston working cavities 12 and 14 via channel 10, and above-piston working cavities 12 and 14 via channel 10, distributing device 8 and outlet channel 21 in body 11 are then connected with a drain tank or sump. The pressure in above-piston working cavities 12 and 14 falls, and power pistons 1 and 2 together with plunger 3 return into the initial upper extreme position under the action of spring with the seat 17 of the return mechanism.

Changes in cyclic fuel deliveries in pump-injectors are achieved by controlling the value of the working stroke of power pistons and pumping plunger by changing the duration of the electric signal fed to the controlling valve of the distributing device (in the model described here, the signal is fed to the electromagnet of the controlling valve).

Pump-injector corresponding to the functional diagram shown in FIG. 2 operates essentially in a similar way to that shown in FIG. 1 and described above, except for the fact that the actuating fluid is supplied from above-piston space 12 of the upper piston 1 (leader) into above-piston cavity 14 of the lower piston 2 (follower) via channel 22 formed in rod 15, said rod 15 being tightly attached to piston 1 by threaded joint 23 or manufactured as a single piece with piston 1. In order to enable the flow of the actuating fluid from above-piston working cavity 12 into channel 22 of rod 15, an opening 24 is made in the bottom of piston 1, and in order to enable the flow of the actuating fluid from channel 22 into above-piston working cavity 14 of power piston 2, slots 25 are made in rod 15.

The proposed multi-piston actuating mechanism allows for achieving rate shape due to phase (time) shift in supplying the actuating fluid into above-piston working cavity 14 of piston 2 as compared to piston 1, i.e. the actuating fluid to above-piston working cavity 14 of piston 2 is supplied later than to above-piston working cavity 12 of piston 1.

To achieve this in a pump-injector shown in FIG. 1 in accordance with the functional diagram shown in FIG. 3, the actuating fluid is supplied via channel 13 into above-piston working cavity 14 of lower piston 2 not directly, but through annular groove 26 made in pump-injector body 11 around piston 2, and the groove is made in such a way that its upper edge 27 is located lower than face 28 of piston 2 by a value of <<h>> when the latter is in the extreme upper position. Therefore, in the beginning of the pistons' and plunger's working stroke, the actuating fluid is supplied only into above-piston working cavity 12 of piston 1, and then, after the pistons travel a pre-defined value of "h" (see FIG. 3), it is fed into above-piston working cavity 14 of piston 2 when groove 26 is opened by face 28 of piston 2. In this case, in the beginning of the working stroke of the pistons and plunger, the force transferred to the plunger will be smaller, and consequently, the injection pressures at the beginning of the working stroke will also be smaller. Changing the position of edge 27 of groove 26 in relation to face 28 of piston 2, i.e. changing the "h" value, one can control the duration of the first, low-efficiency, injection phase.

With regard to the functional diagram shown in FIG. 2 and the functional diagram shown in FIG. 4, moderate rate fuel injection in the beginning phase is achieved due to the fact that lower edge 29 of slots 25 is higher than lower surface 30 of partition 16 when piston 2 is in the extreme upper position, and in the beginning phase of the working stroke of pistons 1 and 2 with plunger 3, the actuating fluid will only be supplied into above-piston working cavity 12 of piston 1. Controlling the open-flow area of the slots and their location in relation to surface 30 of partition 16, i.e. the "m" value in FIG. 4, allows for controlling the rate and duration of the first phase of the injection and thus affects the shape of the injection characteristic, i.e. rate shape.

It will be evident to those skilled in the art that the invention is not limited to the details of the foregoing illustrated embodiments and that the present invention may be embodied in other specific forms without departing from the spirit or essential attributes thereof The present embodiment is therefore to be considered in all respect as illustrative and not restrictive, the scope of the invention being indicated by the appended claims rather than by the foregoing description, and all changes which come within the meaning and range of equivalency of the claims are therefore intended to be embraced therein.

BEST MODE FOR CARRYING OUT OF THE INVENTION

In the proposed invention, the most space-saving design of a multi-piston actuating mechanism (actuating mechanisms may have two pistons or more) can be achieved if the pistons are disposed coaxially one after another, in tandem consisting of a leading piston and the followers, the pistons being also coaxial to the pumping plunger. In the device shown in FIG. 1, where actuating fluid is supplied from the leading piston to the followers via channel 13 in body 11, it is advisable to have pistons of identical diameters, although if there are special layout considerations, the pistons may have different diameters. The difference in the pistons' diameters can also be used for additional correction of rate shape in accordance with the device described above and shown in FIG. 5. In a multi-piston actuating mechanism m accordance with FIG. 2, rod 15 can be connected to the leading piston (from whose above-piston working cavity the actuating fluid is supplied to the above-piston working cavities of other power pistons) by a threaded joint Rod 15 can also be made as part of power piston 1. In this case, there is no need for sealing the thread joint of rod and piston. In order to decrease the fuel flow-over from above-piston working cavity 14 of piston 2 to drain cavity 19 of piston 1, rod 15 that moves in partition 16 must be tightly mounted in the aperture of said partition 16 by precision connection of said components, or by installing a sealing device, for example, a flexible sealing ring. In a variant shown in FIG. 2, it is advisable to use pistons of different diameters, i.e. the upper piston (leader) should have a larger diameter than the lower piston 2 (follower), in order to equalize the forces transferred by each of the two pistons to the pumping plunger. Partition 16, in which rod 15 is moving, can be made as a bushing installed in body 11 in order to facilitate the manufacturing of the pump-injector.

INDUSTRIAL APPLICABILITY

The proposed multi-piston actuating mechanism can be used in various hydraulically driven pump-injectors. However, this mechanism can be most efficient in hydraulically driven pump-injectors for diesels with large working cylinder displacements, and, hence, with high cyclic fuel deliveries. In this case, the need to achieve high injection pressure (2000 bar and higher) requires a high degree of pressure multiplication (10 and higher) in the pressure intensifier. This requirement in single-piston pressure intensifiers leads to a relatively high diameter of the power piston, which in turn leads to an increase in the diameter of the body, and impedes its installation in engine cylinder heads. This drawback is particularly significant when systems with hydraulically driven pump-injectors must be used in the existing diesels with standard fuel systems having conventional injectors or pump-injectors of relatively small diameters. Replacing conventional injectors or pump-injectors with hydraulically driven pump-injectors requires a serious modification of the diesel's cylinder head.

The use of multi-piston actuating mechanisms with pistons of various diameters and stepped delivery of the actuating fluid to each piston as envisaged by the invention, allows for controlling the forefront of the pressure rise in the injection characteristic (rate shape) and thus allows for lowering the rate of the pressure rise in the engine's combustion chamber in the beginning of combustion, increasing the engine's durability and life, lowering its noise and, most important, decreasing the formation of the toxic nitric oxides in the exhaust gases.

The use of the proposed actuating mechanisms is especially expedient in hydraulically driven pump-injectors intended for newly-designed high-power diesels, although the proposed actuating mechanisms can also be used in pump-injectors of the existing diesels.

I claim:

1. An actuating mechanism of an hydraulically driven pump-injector for internal combustion engines, in particular for diesels, comprising:

a body formed with internal working cavities, an inlet channel adapted to receive actuating fluid from an accumulator, and outlet channels adapted for exit flow of the actuating fluid from the body;

a distributing device with a valve mounted in the body between said inlet and outlet channels, for providing actuating fluid to the working cavities;

a leader power piston located in a first internal working cavity of the body;

at least one follower power piston located in a second internal working cavity of the body such that the leader power piston is interposed between the follower power piston and the distributing device;

a pumping plunger;

the leader power piston, the at least one follower power piston, and the pumping plunger being adapted to move between an upper position and a lower position;

the actuating mechanism being formed with at least one additional channel for connecting the second internal working cavity of the at least one follower power piston with the first internal working cavity of the leader power piston, when the at least one follower power piston is in the lower position; and a return mechanism for returning the leader power piston and the at least one follower power piston with the pumping plunger.

2. Actuating mechanism as in claim 1, wherein said leader power and the at least one follower power piston are disposed coaxially with each other and with the pumping plunger, in tandem consisting of the first piston and subsequent pistons.

3. Actuating mechanism as in claim 2, further comprising at least one sliding rod installed between the power pistons transferring the force from one piston to another.

4. Actuating mechanism as in claim 3, wherein said at least one sliding rod moves in partitions formed directly in said body or in bushings tightly installed in the body, said partitions separating a drain cavity of a previous piston from a working cavity of a subsequent piston, and the working cavity of the leader piston is bounded by the surface of the internal cylindrical cavity of the body.

5. Actuating mechanism as in claim 4, wherein said at least one sliding rod has a precision connection with the appropriate openings in the partitions in which they are moving.

6. Actuating mechanism as in claim 4, further comprising sealing devices installed between said at least one sliding rod and in the partitions.

7. Actuating mechanism as in claims 4, 5 or 6, wherein said leader power piston and the at least one follower power piston have identical diameters.

8. Actuating mechanism as in claim 1, wherein in said body a channel is made for connecting the working cavity of the leader power piston with the distributing device.

9. Actuating mechanism as in claim 3, wherein said leader power piston has an opening formed therein which adjoins a channel formed in said at least one sliding rod disposed along its axis in such a way that the actuating fluid is fed from said first internal working cavity of said leader power piston into said second working cavity of said at least one follower power piston of the tandem.

10. Actuating mechanism as in claim 8, wherein said at least one rod with the channel adjoining the leader power piston is fixed to the leader power piston by means of a threaded joint, or is made as a single piece with the leader power piston.

11. Actuating mechanism as in claim 1, wherein said at least one additional channel is connected to an annular groove formed in said body, the annular groove encircling the at least one follower power piston, an upper edge of said annular groove being located below an upper face of the at least one follower power piston when the at least one follower power piston is in said upper position, such that actuating fluid is only fed into the second internal working cavity of the at least one follower power piston from the first internal working cavity of the leader power piston after the start of the working stroke of the power piston, the at least one follower power piston and the pumping plunger.

12. Actuating mechanism as in claim 9 or 10, wherein said at least one sliding rod, through whose channel actuating fluid is fed into the second internal working cavity of the at least one follower power piston from said first internal working cavity of the leader power piston, is formed with at a slot connected to the central channel of the rod, and through which actuating fluid is fed into the second internal working cavity; a lower edge of the slot being disposed above a lower surface of a partition in which the rod is moving, so that when the leader power piston and the at least one follower power piston are in the upper position, actuating fluid is fed into the second internal working cavity of the at least one follower power piston from the first internal working cavity of the leader power piston after the beginning of the working stroke of the leader power piston, the at least one follower power piston and the pumping plunger.

13. Actuating mechanism as in claim 1, wherein the actuating mechanism is disposed in said body which is built in a pump-injector body or is installed directly in a pump-injector body.

14. Actuating mechanism as in claim 4, wherein said leader power piston and the at least one follower power piston have different diameters.

15. Actuating mechanism of hydraulically driven pump-injector for internal combustion engines, in particular for diesels, comprising:

a body with inlet and outlet channels for connection with an accumulator of actuating fluid and a drain tank, respectively;

a multi-piston pressure intensifier located in the internal cylindrical working cavities of the body comprising of two power pistons or more and a pumping plunger, the working cavities being formed above the power pistons in the body, and drain cavities being formed under the pistons in the body and being connected by additional channels formed in the body with the drain tank;

a distributing device with a valve, mounted in the body between said inlet and outlet channels and the working cavities of the power pistons; and a return mechanism of the power pistons with pumping plunger.

16. An actuating mechanism of a hydraulically driven pump-injector for internal combustion engines, in particular for diesels, comprising:

a body formed with internal working cavities, an inlet channel adapted to receive actuating fluid from an accumulator, and outlet channels adapted for exit flow of the actuating fluid from the body;

a distributing device mounted in the body between said inlet and outlet channels, for providing actuating fluid to the working cavities;

a leader power piston located in a first internal cavity of the body;

a follower power piston located in a second internal working cavity of the body such that the leader power piston is interposed between the follower power piston and the distributing device, the follower power piston being adapted to move between an upper position and a lower position; and the actuating mechanism being formed with a channel for connecting the second internal working cavity of the follower power piston with the first internal working cavity of the leader power piston, when the follower power piston is in the lower position.

* * * * *